US011287222B2

(12) United States Patent
Janik

(10) Patent No.: US 11,287,222 B2
(45) Date of Patent: Mar. 29, 2022

(54) APPARATUS AND METHOD FOR REMOTELY SELECTING THE FUSE MODE OF A LASER GUIDED MUNITION

(71) Applicant: BAE SYSTEMS Information and Electronic Systems Integration Inc., Nashua, NH (US)

(72) Inventor: Richard Janik, Tucson, AZ (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 262 days.

(21) Appl. No.: 16/552,711

(22) Filed: Aug. 27, 2019

(65) Prior Publication Data

US 2021/0278174 A1 Sep. 9, 2021

(51) Int. Cl.

| | |
|---|---|
| ***F41G 7/22*** | (2006.01) |
| ***F42B 15/01*** | (2006.01) |
| *F41G 7/00* | (2006.01) |

(52) U.S. Cl.

CPC ..... *F41G 7/2293* (2013.01); *F41G 7/226* (2013.01); *F42B 15/01* (2013.01)

(58) Field of Classification Search

CPC ..... F41G 7/2293; F41G 7/226; F41G 7/007; F41G 7/2206; F42B 15/01; F42C 13/00

See application file for complete search history.

(56) References Cited

U.S. PATENT DOCUMENTS

| | | | | |
|---|---|---|---|---|
| 3,722,416 | A * | 3/1973 | Lunt | F42C 13/00 102/270 |
| 4,738,411 | A * | 4/1988 | Ahlstrom | F41G 7/2293 244/3.15 |
| 8,208,130 | B2 | 6/2012 | McConcille et al. | |
| 8,344,302 | B1 | 1/2013 | Murphy et al. | |
| 8,689,692 | B2 * | 4/2014 | Brill | F42B 15/01 102/265 |
| 9,383,170 | B2 | 7/2016 | Ell | |
| 2006/0232761 | A1 * | 10/2006 | McConville | F42B 15/01 356/5.1 |

* cited by examiner

*Primary Examiner* — Bernarr E Gregory

(74) *Attorney, Agent, or Firm* — Maine Cernota & Rardin; Gary McFaline

(57) ABSTRACT

The fuse mode of a laser guided munition is remotely set and/or changed by encoding fuse mode information onto fuse mode designating light received by the light detector of the munition. Embodiments do not require hardware modification of existing munitions and/or control systems. The mode designating light can be the target designating laser light, and the fuse mode information can be encoded together with counter counter measure (CCM) information. Or the mode designating light source can be a separate laser or non-laser light source. Encoding of the fuse mode information can be by modulation and/or wavelength selection of the mode designating light. In embodiments, the fuse mode can be selected before and/or after launch of the munition.

12 Claims, 5 Drawing Sheets

| | |
|---|---|
| 505 - Laser Designator | 510 - Laser Source |
| 515 - Fuse Mode Control Light | 520 - Laser Controller |
| 550 - Seeker Section | 555 - Processing Section |
| 560 - Fuse Setter | 565 - Fuse |

APPARATUS AND METHOD FOR REMOTELY SELECTING THE FUSE MODE OF A LASER GUIDED MUNITION

FIELD

The disclosure relates to precision guided munitions, and more particularly to laser guided munitions.

BACKGROUND

The dramatically higher effectiveness and accuracy of precision guided munitions has caused these weapons to be primary, cost-effective tools for reliably and effectively neutralizing targets while using more lightly armed weapons, expending fewer munitions, reducing collateral damage, and putting fewer troupes in harm's way, as compared to conventional unguided munitions. In particular, laser-guided munitions, such as the Advanced Precision Kill Weapon System laser-guided rocket (APKWS) manufactured by BAE Systems, represent highly important and effective weapons for many applications in modern battlefields.

Laser guided munitions generally use on-board electronics to track targets that are designated by laser, typically in the near-infrared spectrum, and adjust their glide path to precisely strike the target. Since the weapon is tracking a light signature, not the target itself, the target is illuminated (designated) from a separate laser source, such as by ground forces, by a pod on the attacking aircraft, or by a separate support aircraft.

Typically, the warheads on laser guided munitions are designed to be detonated according to specific fusing modes for maximum effectiveness against specific categories of target. For example, the fusing mode of APKWS warheads can be set to Point Detonation (PD), Time-delayed Detonation (TDP), or Height-of-Burst Detonation (HOBD) mode. In many cases, the effectiveness of the weapon is greatly reduced if the fusing mode is not configured according to the optimal choice for a given warhead and target.

One approach to selecting the fusing mode of a laser guided weapon is to physically select the fusing mode before the weapon is placed in the "launch pod" prior to aircraft flight. This approach, however, does not allow a change in fusing mode once the aircraft is airborne nor after the weapon is launched.

Another approach is to integrate a "smart launch pod" onto the aircraft so that the fusing mode of the laser guided weapon can be changed when the aircraft is airborne. However, this approach is costly and complex for both the "smart launch pod' and the aircraft, and requires that the laser guided weapon be modified to work with the "smart launch pod." In addition, this approach also does not allow the fusing mode to be selected or changed after the weapon is launched.

Another approach is to provide a plurality of weapons that are pre-set to different fuse modes. However, this approach tends to be highly inefficient, in that only a fraction of the available weapons can be used for any given target, such that added space, weight, and cost are directed to weapons that will likely not be useful for a given mission. In addition, it can easily happen that weapons are inadvertently placed in the wrong launch tubes, such that weapons having the wrong fuse mode are launched against a target. This approach also does not allow the fuse mode to be selected or changed after the weapon has been launched.

Yet another approach would be to provide a communication system such as a Bluetooth apparatus on the weapon, so that controlling forces could communicate with the weapon either before and/or after it is launched so as to instruct it to select a desired fuse mode. However, this approach would add additional cost, weight, and complexity, both to the weapon and to the aircraft or other platform that launches the weapon, and could reduce the overall mission reliability of the weapon. It would also be more susceptible to interference that might include spoofing and hijacking of the fuse mode.

What is needed, therefore, is a system and method that enables the fuse mode of a laser guided munition to be set and/or changed remotely both before and after it is launched, and ideally without requiring that additional hardware be added to the munition or to the launch platform.

SUMMARY

The present disclosure is a system and method that enables the fuse mode of a laser guided munition to be set and/or changed remotely, i.e. without requiring physical manipulation of the munition. Various embodiments enable the fuse mode to be changed before and/or after launch of the munition. Embodiments do not require any hardware changes or additions to existing designs, and in some embodiments no hardware changes or additions are required for the launch platform. In embodiments the present disclosure can be implemented in existing laser guided munitions as an upgrade, and in some of these embodiments the upgrade to the munition requires only an upgrade to software/firmware of the munition.

The disclosed system and method exploit the fact that one-way laser communication is inherent to most laser guided munitions, in that controlling forces are required to direct a laser beam onto the target and to maintain the presence of the beam throughout the duration of the weapon's flight from launch to target impact. A reflection of the laser beam from the target is detected by a light detector included in the laser guided munition, and is used to guide the munition to the target. As such, the laser beam functions as a method of one-way communication from the controlling forces to the weapon during the flight of the weapon.

Typically, the target designating laser beam is modulated by the laser designator with a specific, predetermined Pulse Rate Frequency (PRF), so as to enable the weapon to distinguish the intended beam from beams that might be directing other munitions, and/or to inhibit hostile forces from spoofing the laser beam and misdirecting the weapon away from its intended target. Because of this latter goal, the beam modulation is sometimes referred to as "counter countermeasure modulation" (CCM). For example, the laser beam can be pulsed at a specified pulse rate or "frequency of the day" that is known to the weapon and its operators, but unknown to hostile forces, so that the weapon is able to ignore other light sources that are not pulsed at the specified CCM rate.

According to the present disclosure, fuse mode designating light is received by a laser guided munition that encodes fuse mode information. The fuse mode information is decoded by a controller included in the munition and is used by the controller to set the fuse mode of the munition while it is in flight.

In embodiments, the fuse mode information is encoded onto the target designating laser beam, such that the reflected target designating beam is also the fuse mode designating light. In embodiments, the CCM modulation pattern of the target designating laser beam is enhanced such that the desired fuse mode is encoded into the target designating laser beam, while the CCM function is also maintained. For example, instead of modulating the laser beam at a steady pulse rate, the laser designator can segment the pulsed beam such that the segmentation pattern indicates the desired fuse-mode, while the pulse rate serves the CCM function. In a simple case, clusters or "bursts" of light pulses can be separated by gaps, such that the laser sensor is able to detect the pulse rate as the CCM feature, while also being able to detect the burst rate as a fuse mode setting feature.

A first general aspect of the present disclosure is a laser guided munition that includes a light detector configured to receive target designating laser light that is reflected from a designated target, said light detector being also configured to receive fuse mode designating light, a warhead having a fuse that is configured to detonate the warhead under control of a fuse mode, said fuse mode being selectable from among a plurality of fuse modes, and a munition controller that is configured to extract fuse mode information from the fuse mode designating light, and to select the fuse mode according to the extracted fuse mode information.

In some embodiments, the fuse mode designating light is the target designating laser light, while in other embodiments the fuse mode designating light is distinct from the target designating laser light. In some of these embodiments the fuse mode designating light is laser light, while in other of these embodiments the fuse mode designating light is not laser light. And in any of these embodiments counter counter measure (CCM) information can be encoded onto the target designating laser light.

In any of the above embodiments, the fuse mode information can be encoded onto the fuse mode designating light as a modulation of the fuse mode designating light. And in some of these embodiments the modulation is a pulsing pattern imposed on the fuse mode designating light.

In any of the above embodiments, the fuse mode designating light can be the target designating laser light, counter counter measure (CCM) information can be encoded onto the target designating laser light as a pulsing rate of pulses of the target designating laser light, and the fuse mode information can be encoded onto the target designating laser light as a burst rate of the pulses, wherein the pulses are grouped into bursts of pulses that are emitted at the burst rate.

In any of the above embodiments, the light detector can be configured to receive the fuse mode designating light and to select the fuse mode before the munition is launched, and/or after the munition is launched.

A second general aspect of the present disclosure is a method of remotely controlling a fuse mode of a laser guided munition. The method includes providing a laser guided munition that includes a light detector configured to receive target designating laser light that is reflected from a designated target, said light detector being also configured to receive fuse mode designating light, a warhead having a fuse that is configured to detonate the warhead under control of the fuse mode, said fuse mode being selectable from among a plurality of fuse modes, and a munition controller that is configured to receive fuse mode information extracted from the fuse mode designating light, and to select the fuse mode according to the extracted fuse mode information. The method further includes launching the munition, designating the target by directing the target designating laser light onto the target, and causing the munition controller to select the fuse mode of the munition by encoding the fuse mode information onto the fuse mode designating light, and causing the fuse mode designating light to impinge upon the light detector of the munition.

In some embodiments, the fuse mode designating light is the target designating laser light, while in other embodiments the fuse mode designating light is distinct from the target designating laser light. In some of these embodiments the fuse mode designating light is laser light, while in other of these embodiments the fuse mode designating light is not laser light. And in any of these embodiments counter counter measure (CCM) information can be encoded onto the target designating laser light.

In any of the above embodiments, the light detector can be configured to receive the fuse mode designating light and to select the fuse mode before the munition is launched, and/or after the munition is launched.

A third general aspect of the present disclosure is non-transitory media included in a laser guided munition said non-transitory media containing software instructions recorded thereupon that can be executed by a munition controller of the laser guided munition to control selection of a fuse mode of the laser guided munition, said laser guided munition including a light detector configured to receive target designating laser light that is reflected from a designated target, and a warhead having a fuse that is configured to detonate the warhead under control of the selected fuse mode, said fuse mode being selectable from among a plurality of fuse modes. The software instructions are configured to cause the munition controller to receive fuse mode information extracted from fuse mode designating light detected by the light detector; and select the fuse mode of the munition according to the fuse mode information.

In embodiments, executing the software instructions does not require any change to or modification of any hardware included in said laser guided munition.

And in any of the above embodiments, the software instructions can be configured to cause the munition controller to receive the fuse mode information and select the fuse mode before and/or after the munition is launched.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present disclosure is a system and method that enables the fuse mode of a laser guided munition to be set and/or changed remotely, i.e. without requiring physical manipulation of the munition. As used herein, weapon, projectile, munition, smart rocket, and precision guided munition are used interchangeably. Various embodiments enable the fuse mode to be changed before and/or after launch of the munition, depending on the laser guided weapon configuration. Embodiments do not require any hardware changes or additions to existing designs, and in some embodiments no hardware changes or additions are required for the launch platform. In embodiments the present disclosure can be implemented in existing laser guided munitions as an upgrade to an existing munition controller, and in some of these embodiments the upgrade to the munition controller requires only an upgrade to software/firmware of a processor included in the munition controller.

Figure 1:
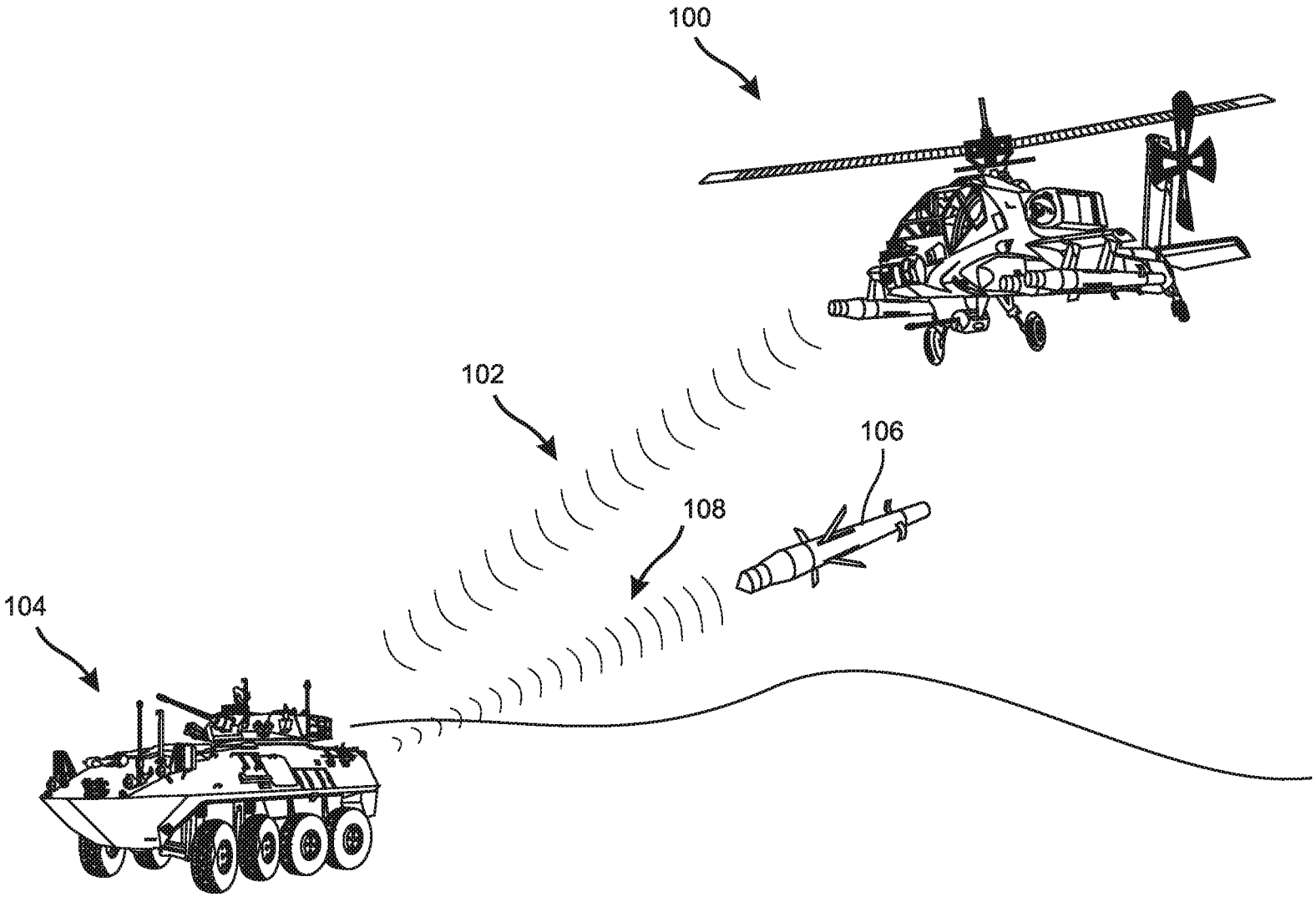
FIG. 1 is a perspective view that illustrates transmitting of a target designating and fuse mode designating laser beam by a munition launch platform that is reflected from a target and received by a laser guided munition according to the present disclosure.

With reference to FIG. 1, the disclosed system and method exploit the fact that one-way laser communication is inherent to laser guided munitions, in that controlling forces 100 are required to direct a laser beam 102 onto the target 104 and to maintain the presence of the beam throughout the duration of the flight of the weapon 106 from launch to target impact. The one-way laser communication in one example does not need to be maintained for the entire duration of the munition flight as the dynamic fuse mode can be changed and the munition may continue to the target with or without a continuous laser communication. For example, the munition may have reached a point where the target is already locked in and no further laser guidance is required. The munition may also have other sensor modes such that other sensors can be used to guide the munition.

A reflection 108 of the laser beam from the target 104 is detected by a light detector included in the laser guided munition 106, and is used to guide the munition 106 to the target 104. As such, the laser beam 102, 108 functions as a method of one-way communication from the controlling forces 100 to the munition 106 during the flight of the munition 106.

For existing laser guided munitions the target designating laser beam 102 includes a "counter countermeasure modulation" (CCM) that enables the weapon 106 to distinguish the designating laser beam 108 that is reflected from the intended target from beams that might be directing other munitions, and/or to inhibit hostile forces from spoofing the laser beam and misdirecting the weapon away from its intended target.

According to the present disclosure, this concept is expanded by causing a laser guided munition to receive fuse mode designating light that encodes fuse mode information. The fuse mode information is then decoded by the munition and is used by the munition to set its fuse mode. In a further example, a default fuse mode is established just in case the munition is unable to receive a new fuse mode designation or unable to process the new fuse mode.

In embodiments, the fuse mode information is encoded onto the target designating laser beam 102, such that the reflected target designating beam 108 is also the fuse mode designating light. In embodiments, the CCM modulation pattern of the target designating laser beam is enhanced such that the desired fuse mode is encoded into the target designating laser beam Pulse Rate Frequency (PRF), while the CCM function is also maintained.

Figure 2:
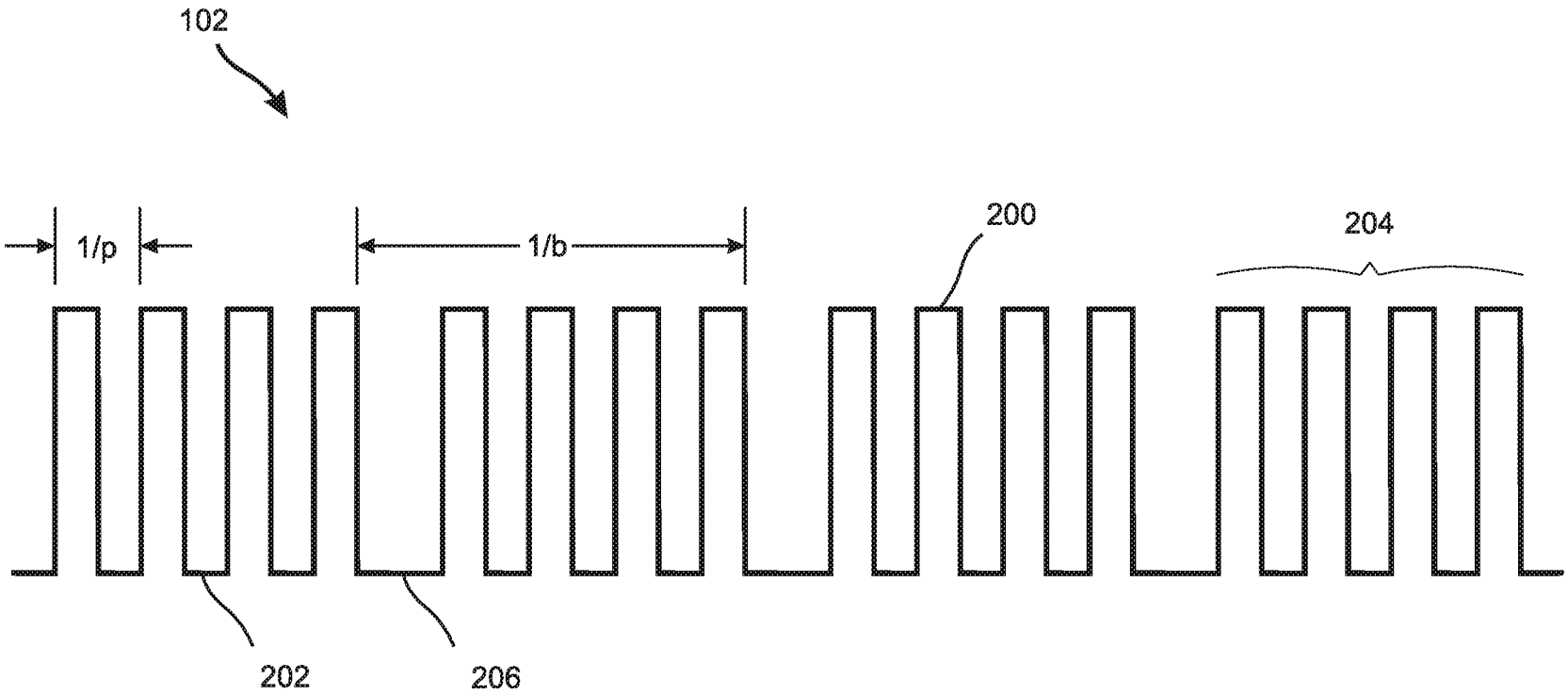
FIG. 2 illustrates a laser pulsing PRF pattern that encodes both CCM and fuse mode information onto a laser beam according to an embodiment of the present disclosure.

FIG. 2 present an example wherein the target designating laser beam 102 is modulated into a series of pulses 200 that are separated by pulse gaps 202 so as to establish a CCM pulsing rate "p" (time between pulses=1/p). The train of pulses 200 is further divided into a series of pulse "bursts" 204 by burst gaps 206 that are larger than the pulse gaps 202. Two timing rates are thereby encoded into the laser beam 102, namely the pulse rate "p" and the burst rate "b" (time between bursts=1/b). A weapon 106 that includes appropriate software/firmware is thereby able to detect these two timing values as it follows the reflected beam 108 to the target 104, and to use the pulse timing to verify that the intended beam is being tracked while at the same time using the burst timing to set and verify the desired fuse mode. In embodiments, the guidance laser, or a separate fuse mode control laser source included with the launch platform 100, can be used to set the fuse mode of the weapon 106 before it is launched.

It will be clear to one of skill in the art that many types and combinations of encoding can be used in embodiments to encode fuse mode information into the fuse mode designating light. These include, but are not limited to, laser pulse widths, laser amplitude modulations, and/or light wavelengths and/or wavelength selections and/or modulations. For example, rather than modulating a fuse mode designating laser beam, the desired fuse mode can be indicated by the wavelength of the fuse mode designating light. It will also be clear that the fuse mode designating light need not be generated as a laser beam. For example, fuse mode designating light that is applied to the munition before it is launched can be generated by a non-laser light source that is proximal to the munition during storage thereof.

It will further be clear to one of skill in the art that some embodiments require no hardware modifications to either the munition or to the launch platform and other support systems, as compared to conventional systems, while other embodiments do require some hardware upgrades and/or changes as compared to conventional hardware. Examples of the latter group of embodiments include the addition of an additional fuse mode setting laser to the launch platform, configured for example to apply a fuse setting command to the munition before it is launched. Other examples include modifications in some embodiments to the munition itself, for example to enable the munition to detect and distinguish a plurality of different laser wavelengths. In embodiments, for example, target designating laser beam and the fuse mode designating laser beam are separate laser beams emitted at different wavelengths. And in various embodiments, it is the wavelength of the fuse mode designating laser beam that indicates the desired fuse mode, rather than or in addition to a modulation of the fuse mode designating laser beam.

Figure 3:
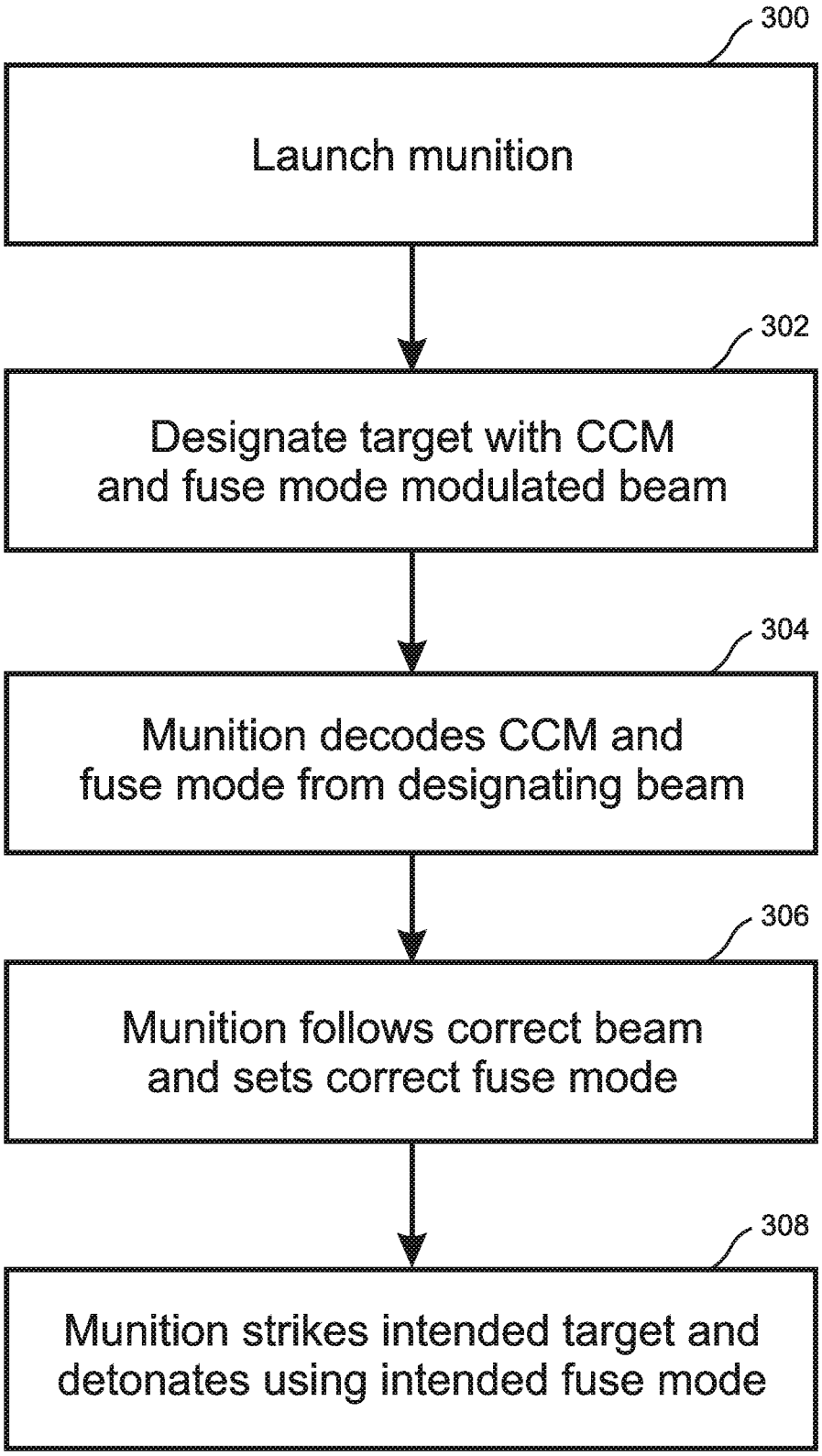
FIG. 3 is a flow diagram that illustrates a method embodiment of the present disclosure in which the fuse mode of a laser guided munition is remotely set after the munition is launched.

FIG. 3 is a flow diagram that illustrates a method embodiment of the present disclosure, wherein the fuse mode is set after the munition is launched. According to this example, after the munition is launched 300, the target 104 is designated 302 by a laser beam 102 into which are encoded both a CCM modulation and a fuse setting mode modulation. During flight, the munition 106 detects the reflection 108 of the laser beam 102 from the target 104, and decodes the CCM identification and the fuse mode 304 from the beam modulation. As a result, during flight the munition 106 directs its course to the intended target and also sets its fuse to the correct mode 306, which causes the munition 106 to strike the intended target 104 and to detonate using the intended fuse mode 308.

Figure 4:
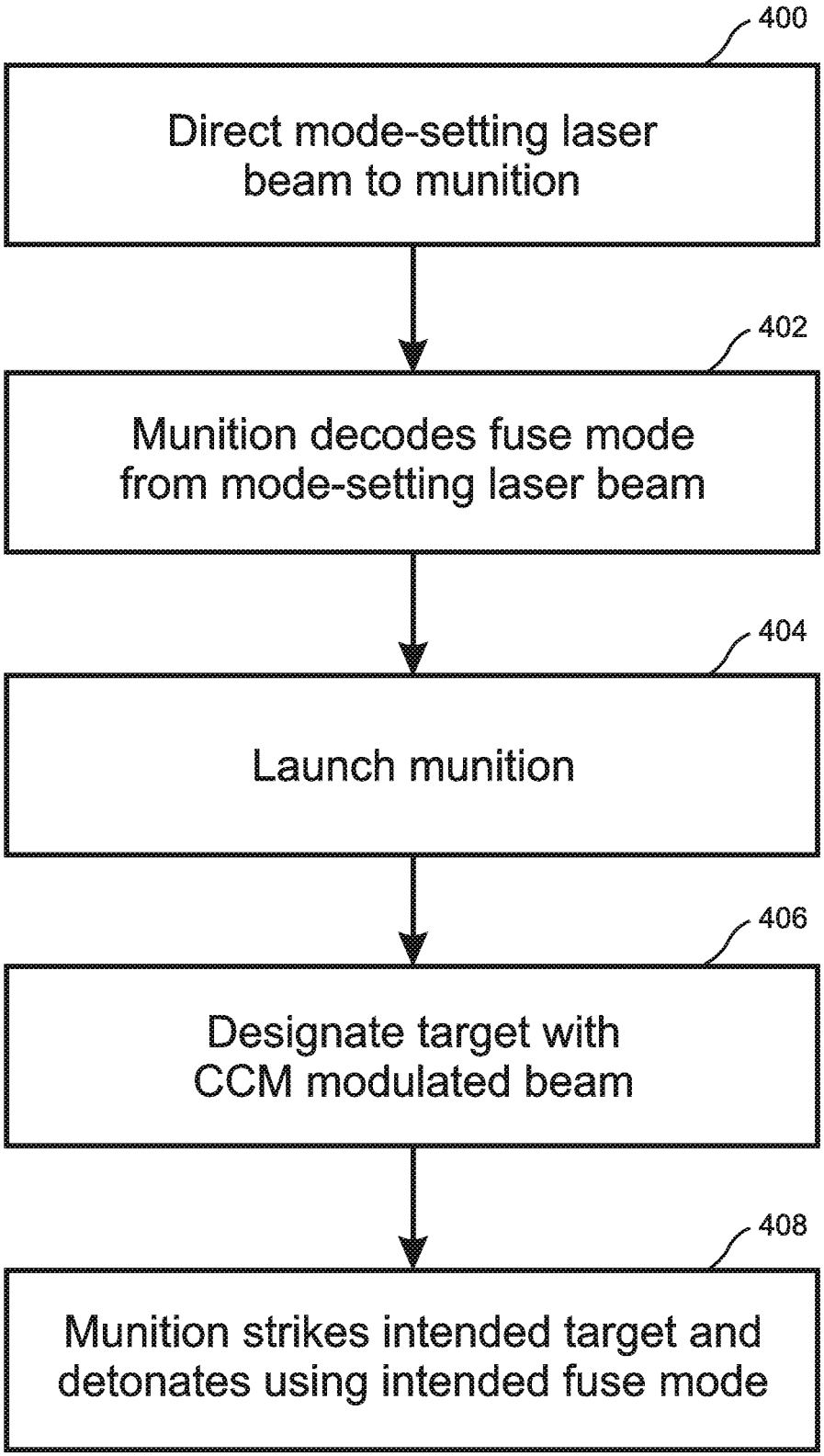
FIG. 4 is a flow diagram that illustrates a method embodiment of the present disclosure in which the fuse mode of a laser guided munition is remotely set before the munition is launched.

FIG. 4 is a flow diagram that illustrates an alternate method embodiment of the present disclosure, wherein the fuse mode is set before the munition is launched. According to this example, at least one mode setting laser is included in the launch platform 100, and the munition 106 is programmed to receive and decode mode setting laser signals even before it is launched. Accordingly, before launch a mode setting laser is caused to direct a mode setting laser beam to the munition 400. The munition receives the mode setting laser beam, decodes the fuse mode from the beam, and sets its fuse mode accordingly 402. The munition is then launched 404, and the target 104 is designated 406 by a laser beam 102 into which is encoded a CCM modulation. In embodiments, the fuse mode can also be encoded into the target designating beam 102 so as to confirm, and/or change the fuse mode after launch. Ultimately 408, the munition 106 strikes the intended target 104 and detonates using the intended fuse mode 308.

Figure 5:
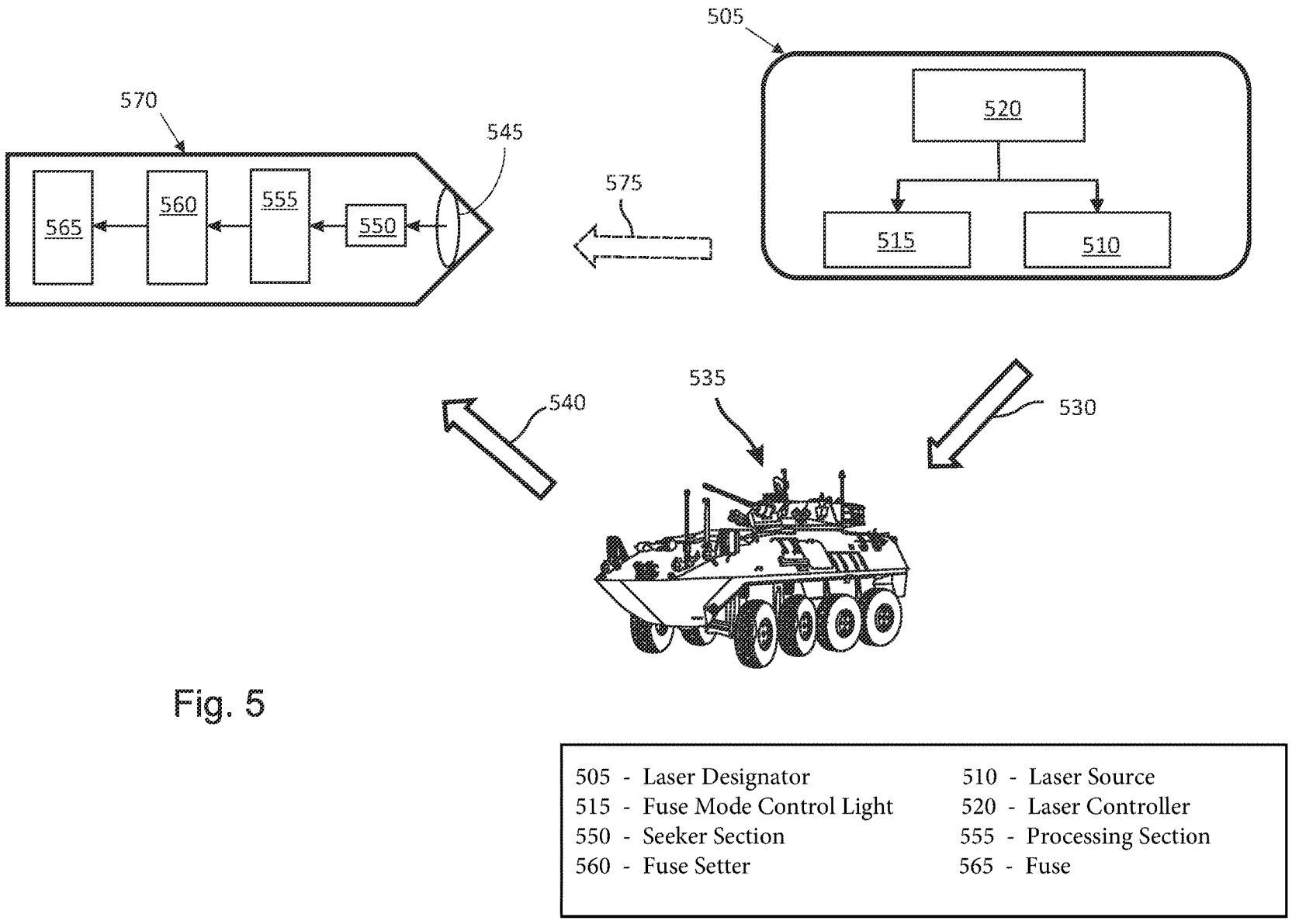
FIG. 5 is a block diagram that illustrates elements included in the laser designator and laser guided munition in an embodiment of the present disclosure.

Referring to FIG. 5, the laser designator 505, whether airborne, ground, or maritime based, includes a laser source 510 that is configured for designating a target 535. While the laser designator 505 may be on the same platform as the munition 570, the laser designator 505 may also be at a different location. In embodiments, the target designating laser source 510 is coupled to a laser controller 520 that applies the CCM modulation and encodes the fuse mode instructions onto the targeting laser beam 530. In one example, implementation of the present disclosure does not require modification of the hardware elements of the laser designator 505 in that the added capability of the present disclosure is implemented via software that can direct the laser controller 520 to encode the fuse mode instruction onto the targeting laser emissions 530.

In other embodiments, either the laser designator 505 or the platform that launches the munition 570 includes an optional fuse mode control light source 515 that is separate from the target designating laser source 510, where the fuse mode control light source can be, but is not necessarily, a laser light source. In this latter mode, the target designating laser source 510 can be used in its normal operating mode, while the separate fuse mode control light source 515 is used exclusively to transmit a fuse mode instruction light signal 575 to the munition 570, either prior to launch or after launch.

There are various fuse modes such as point-detonation, point-detonation delay, and height of burst. The selection between the modes is based on information that may be gathered prior to or after launch and processed to provide the desired effect. For example, in some cases the information may identify nearby resources where it is desired to localize damage, resulting in a preference for a point-detonation delay fuse mode. In another example, the information might indicate that maximum damage would result from the height of burst mode.

At the munition 570, the reflected laser beam 540 is an input to a lens 545 that provides an optical input to a seeker section 550. The seeker section 550 is coupled to a processing section 555 that processes the received information, including the CCM modulation frequency and the fuse mode instruction. The processing section 555 then provides the fuse mode instructions to a fuse setter 560 that sets the mode of the fuse 565.

The foregoing description of the embodiments of the disclosure has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the disclosure to the precise form disclosed. Many modifications and variations are possible in light of this disclosure.

Although the present application is shown in a limited number of forms, the scope of the disclosure is not limited to just these forms, but is amenable to various changes and modifications without departing from the spirit thereof. The disclosure presented herein does not explicitly disclose all possible combinations of features that fall within the scope of the disclosure. The features disclosed herein for the various embodiments can generally be interchanged and combined into any combinations that are not self-contradictory without departing from the scope of the disclosure. In particular, the limitations presented in dependent claims below can be combined with their corresponding independent claims in any number and in any order without departing from the scope of this disclosure, unless the dependent claims are logically incompatible with each other.

I claim:

1. A laser guided munition comprising:

a light detector configured to receive target designating laser light that is reflected from a designated target, said light detector being also configured to receive fuse mode designating light;

a warhead having a fuse that is configured to detonate the warhead under control of a fuse mode, said fuse mode being selectable from among a plurality of fuse modes; and a munition controller that is configured to extract fuse mode information from the fuse mode designating light, and to select the fuse mode according to the extracted fuse mode information.

2. The munition of claim 1, wherein the fuse mode designating light is the target designating laser light.

3. The munition of claim 2, wherein counter counter measure (CCM) information is also encoded onto the target designating laser light.

4. The munition of claim 1, wherein the fuse mode information is encoded onto the fuse mode designating light as a modulation of the fuse mode designating light.

5. The munition of claim 4, wherein the modulation is a pulsing pattern imposed on the fuse mode designating light.

6. The munition of claim 1, wherein:

the fuse mode designating light is the target designating laser light;

counter counter measure (CCM) information is encoded onto the target designating laser light as a pulsing rate of pulses of the target designating laser light; and the fuse mode information is encoded onto the target designating laser light as a burst rate of the pulses, wherein the pulses are grouped into bursts of pulses that are emitted at the burst rate.

7. The munition of claim 1, wherein the light detector is configured to receive the fuse mode designating light and to select the fuse mode before the munition is launched.

8. The munition of claim 1, wherein the light detector is configured to receive the fuse mode designating light and to select the fuse mode after the munition is launched.

9. A method of remotely controlling a fuse mode of a laser guided munition, the method comprising:

providing a laser guided munition that includes:

a light detector configured to receive target designating laser light that is reflected from a designated target, said light detector being also configured to receive fuse mode designating light;

a warhead having a fuse that is configured to detonate the warhead under control of the fuse mode, said fuse mode being selectable from among a plurality of fuse modes; and a munition controller that is configured to receive fuse mode information extracted from the fuse mode designating light, and to select the fuse mode according to the extracted fuse mode information;

launching the munition;

designating the target by directing the target designating laser light onto the target; and causing the munition controller to select the fuse mode of the munition by:

encoding the fuse mode information onto the fuse mode designating light; and causing the fuse mode designating light to impinge upon the light detector of the munition.

10. The method of claim 9, wherein the fuse mode designating light is the target designating laser light.

11. The method of claim 10, wherein the step of directing the target designating laser light onto the target further comprises encoding counter counter measure (CCM) information onto the target designating laser light.

12. The method of claim 9, wherein the step of causing the fuse mode designating light to impinge upon the light sensor of the munition precedes the step of launching the munition.

* * * * *